US008472824B2

(12) United States Patent
Yamaki et al.

(10) Patent No.: US 8,472,824 B2
(45) Date of Patent: Jun. 25, 2013

(54) IMAGE FORMING APPARATUS EMPLOYING TWO CLEANING BLADES

(75) Inventors: Hideo Yamaki, Tokyo (JP); Yusuke Nishisaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 218 days.

(21) Appl. No.: 13/043,048

(22) Filed: Mar. 8, 2011

(65) Prior Publication Data

US 2011/0222885 A1 Sep. 15, 2011

(30) Foreign Application Priority Data

Mar. 15, 2010 (JP) ..... 2010-057225

(51) Int. Cl.
*G03G 15/16* (2006.01)
*G03G 15/00* (2006.01)
*G03G 15/20* (2006.01)

(52) U.S. Cl.
USPC ..... 399/66; 399/72; 399/101; 399/314

(58) Field of Classification Search
USPC ..... 399/314, 366
See application file for complete search history.

(56) References Cited

U.S. PATENT DOCUMENTS

| | | | | |
|---|---|---|---|---|
| 5,168,313 | A * | 12/1992 | Hosaka et al. | 399/313 |
| 7,486,900 | B2 * | 2/2009 | Omata | 399/49 |
| 2005/0147424 | A1 * | 7/2005 | Kato et al. | 399/49 |
| 2005/0220478 | A1 * | 10/2005 | Ai et al. | 399/101 |
| 2008/0187351 | A1 * | 8/2008 | Takishita | 399/101 |
| 2009/0185839 | A1 * | 7/2009 | Shiiya | 399/313 |
| 2010/0142985 | A1 * | 6/2010 | Minbe et al. | 399/66 |
| 2010/0226699 | A1 * | 9/2010 | Kamijo et al. | 399/314 |

FOREIGN PATENT DOCUMENTS

| | | | |
|---|---|---|---|
| JP | 11-272135 | | 10/1999 |
| JP | 2000-019920 | | 1/2000 |
| JP | 2007-240768 | | 9/2007 |
| JP | 2007240768 | A * | 9/2007 |

* cited by examiner

*Primary Examiner* — David Gray
*Assistant Examiner* — Tyler Hardman
(74) *Attorney, Agent, or Firm* — Lucas & Mercanti, LLP

(57) ABSTRACT

An image forming apparatus includes: a cleaning blade provided on an intermediate transfer member to which a toner image formed on at least one image forming section is primary transferred and on a secondary transfer section which transfers the toner image transferred on the intermediate transfer member onto a transfer material, respectively, which cleans the toner image remained thereon, respectively; a bias power source which is electrically connected to the secondary transfer section; and a controller which causes the image forming section to form a patch toner image onto a non-image area on the image carrier corresponding to an area between adjoining two transfer materials, and causes the bias power source to conduct a power control in synchronization with a positional movement timing of the patch toner image, to supply selectively the patch toner image to the intermediate transfer member and the secondary transfer section.

14 Claims, 7 Drawing Sheets

IMAGE FORMING APPARATUS EMPLOYING TWO CLEANING BLADES

This application is based on Japanese Patent Application No. 2010-057225 filed on Mar. 15, 2010, which is incorporated hereinto by reference.

BACKGROUND OF THE INVENTION

The invention of the present patent application relates to an image forming apparatus such as a copying machine and a printer each forming an image by using an electrophotographic method in which a cleaning section that is composed of a blade is equipped on each of an intermediate transfer member and a secondary transfer section.

In the image forming apparatus such as a copying machine or a printer that forms an image by using electrophotographic method, charging, exposure and developing processing, for example, are carried out on an image carrier that is composed of a photoconductor drum, and a toner image is formed. After that, the aforesaid toner image is transferred onto a transfer material, or, a toner image after being transferred onto an intermediate transfer member composed of, for example, a belt, is transferred onto a toner image (secondary transfer), and after that, there is a structure wherein fixing processing is conducted and a toner image is fixed on a transfer material. The image forming apparatus of this kind is equipped with a cleaning blade (hereinafter called as a blade simply) for cleaning the surface of the intermediate transfer member.

Meanwhile, there is known a problem of turning up of a blade which is one of problems that take place when a blade is used as a cleaning section, and it is well-known as a measure for the problem that an appropriate amount of toner that does not affect ordinary image forming is given to the blade.

For example, Unexamined Japanese Patent Application Publication No. 2007-240768 discloses an image forming apparatus having the structure wherein color toner images formed on four photoconductors are composed on an intermediate transfer belt, and then, are transferred onto a transfer material. Further, a blade is provided for the image carrier that is composed of a photoconductor or an intermediate transfer belt. And, with respect to toner supply for the blade, distribution of total number of pixels relating to the sub-scanning direction of images formed on the image carrier, for example, is calculated, and a patch pattern of toner is formed on a non-image area on the image carrier that corresponds to a pixel section that is less than a prescribed threshold value in the aforesaid distribution. After that, toner that is forming the patch pattern is conveyed to the blade without being transferred onto the transfer material, to be accomplished. (As a result, sliding of the blade on an edge portion for the image carrier is maintained to be in an excellent state, to prevent turning up of the blade, and the cleaning capacity of the blade is maintained.)

Unexamined Japanese Patent Application Publication No. H11-272135 discloses the image forming apparatus that is equipped with a transfer belt that is caused to travel along the image carrier and conveys a transfer material to a developer image on the image carrier. The aforesaid image forming apparatus has a blade provided for the transfer belt and an exposure device that forms a line image for supplying toner serving as a lubricant to the transfer belt. And, supplying toner to the blade is accomplished by forming a line image on the image carrier in the case of initializing the apparatus and by conveying toner in a quantity adjusted by the number of conveyed transfer materials through the transfer belt to the blade. (An achievement of an excellent cleaning power corresponding to a degree of damage of the transfer belt and a prevention of turning up of a blade are targeted.)

Unexamined Japanese Patent Application Publication No. 2000-19920 discloses the image forming apparatus that has therein a transfer belt and a blade provided on each of the image carrier and the transfer belt. An image forming on the transfer material is carried out when color images in various colors are recorded successively on transfer materials on a multiple superimposing recording basis. And, with respect to toner supply for the blade, it is accomplished by watching an amount of toner adhesion for each of areas divided into plurality in the main scanning direction of the image carrier, by setting a toner adhesion mode in case of need, and by supplying toner in an appropriate amount to a non-image area on the image carrier, corresponding to an area where toner supply is required.

Though constitutions of image forming apparatuses disclosed in Unexamined Japanese Patent Application Publication Nos. 2007-240768, H11-272135 and 2000-19920 are different from each other, various technologies for preventing blade turning up in the constitutions are guessed to be extremely useful. However, a target on which a blade is to be provided is an image carrier composed of a photoconductor and a transfer belt that conveys a transfer material, or an intermediate transfer member onto which a toner image formed on the image carrier is to be transferred, and constitutions other than the aforesaid items are not considered, which lacks a multiplicity of uses.

On the other hand, as a configuration of an image forming apparatus, there is considered the constitution wherein a belt-shaped toner patch (hereinafter, referred to as a patch image) is prepared on a non-image area of the image carrier corresponding to a transfer material clearance, for example, and it is caused to be transferred onto a secondary transfer device such as a roller through an intermediate transfer member. Specifically, a turning up of a blade is prevented by causing toner that forms the aforesaid patch image to be moved on a secondary transfer section such as a roller through the intermediate transfer member and by supplying toner to the blade provided on the surface of the secondary transfer section to be touched. Further, the patch image is made to be a belt-shaped image having a length that covers the total length of the blade. Incidentally, the aforesaid patch image may either be one that is utilized as a factor for acquiring stabilization of image density such as, for example, developing voltage control, or be one that is supplied to the blade of the secondary transfer section to be used only for the purpose to prevent turning up of a blade. The image forming apparatus having the constitution of this type can maintain high productivity, and it is expected to offer high image quality in color image forming.

However, when the constitution is made to be one wherein a blade is provided also for the secondary transfer section, in addition to a blade provided to correspond to the intermediate transfer member, it is impossible to prevent turning up of the blade if toner is not supplied to both blades stably. But then, if it is tried to fulfill an amount of toner supply, there is no option but to increase an amount of toner consumed to form patch image inevitably, and further, in some cases, it is impossible to supply toner between transfer materials, and it is forced to suspend print operations, resulting in a fault that high productivity cannot be maintained.

SUMMARY OF THE INVENTION

The invention of the present patent application relate to an image forming apparatus having the structure wherein a blade is provided also for the secondary transfer device in addition to an intermediate transfer member, and it is one accomplished in view of the defect owned by an image forming apparatus having the aforesaid structure. And it is one accomplished in view of the matter to broaden a multiplicity of uses of the image forming apparatus disclosed in the aforesaid Patent Documents. A main object is to provide an image forming apparatus wherein a patch image of toner formed between adjoining two transfer materials can be supplied selectively to a blade of the intermediate transfer and to a blade of the secondary transfer section through a simple structure.

The invention of the present patent application can be achieved by the following compositional requirements.

1. To achieve at least one of the abovementioned objects, an image forming apparatus reflecting one aspect of the present invention comprises a plurality of image carriers, image forming devices corresponding to the aforesaid image carriers, an intermediate transfer member onto which a toner image formed on at least one of the aforesaid image carriers is transferred, a secondary transfer section that transfers the toner image which has been transferred onto the aforesaid intermediate transfer member onto a transfer material, cleaning blades each being provided on each of the intermediate transfer member and the secondary transfer section to clean remaining toner image, a bias power supply that is connected electrically to the secondary transfer section, and a controller is capable of forming a patch toner image on a non-image area on the aforesaid image carrier corresponding to an area between adjoining two transfer materials, and capable of supplying the patch toner image to the secondary transfer section, wherein the aforesaid controller is capable of conducting energizing control for the aforesaid bias power supply, synchronizing with position moving timing for the patch toner image so that the patch toner image can be supplied selectively to the intermediate transfer member and to the secondary transfer section.

2. It is preferable that the aforesaid secondary transfer section is a roller in the image forming apparatus in the aforesaid item 1.

3. It is preferable that the aforesaid secondary transfer section includes a roller and a belt that is trained about the roller in the image forming apparatus in the aforesaid item 1.

4. It is preferable that power distribution control conducted by the aforesaid controller is an ON-OFF switching control for the bias power supply output in the image forming apparatus in the aforesaid item 1.

5. It is preferable that power distribution control conducted by the aforesaid controller is an output variable control for the bias power supply, in the image forming apparatus in the aforesaid item 1.

6. It is preferable that power distribution control conducted by the aforesaid controller is carried out depending on a record of the possession range in the image area of a transfer material transferred by the secondary transfer section, in the image forming apparatus described in the aforesaid item 4 or 5.

DETAILED DESCRIPTION OF THE PREFERRED EMBODIMENT

Embodiments relating to the invention of the present patent application will be explained as follows, based on the drawings.

Figure 1:
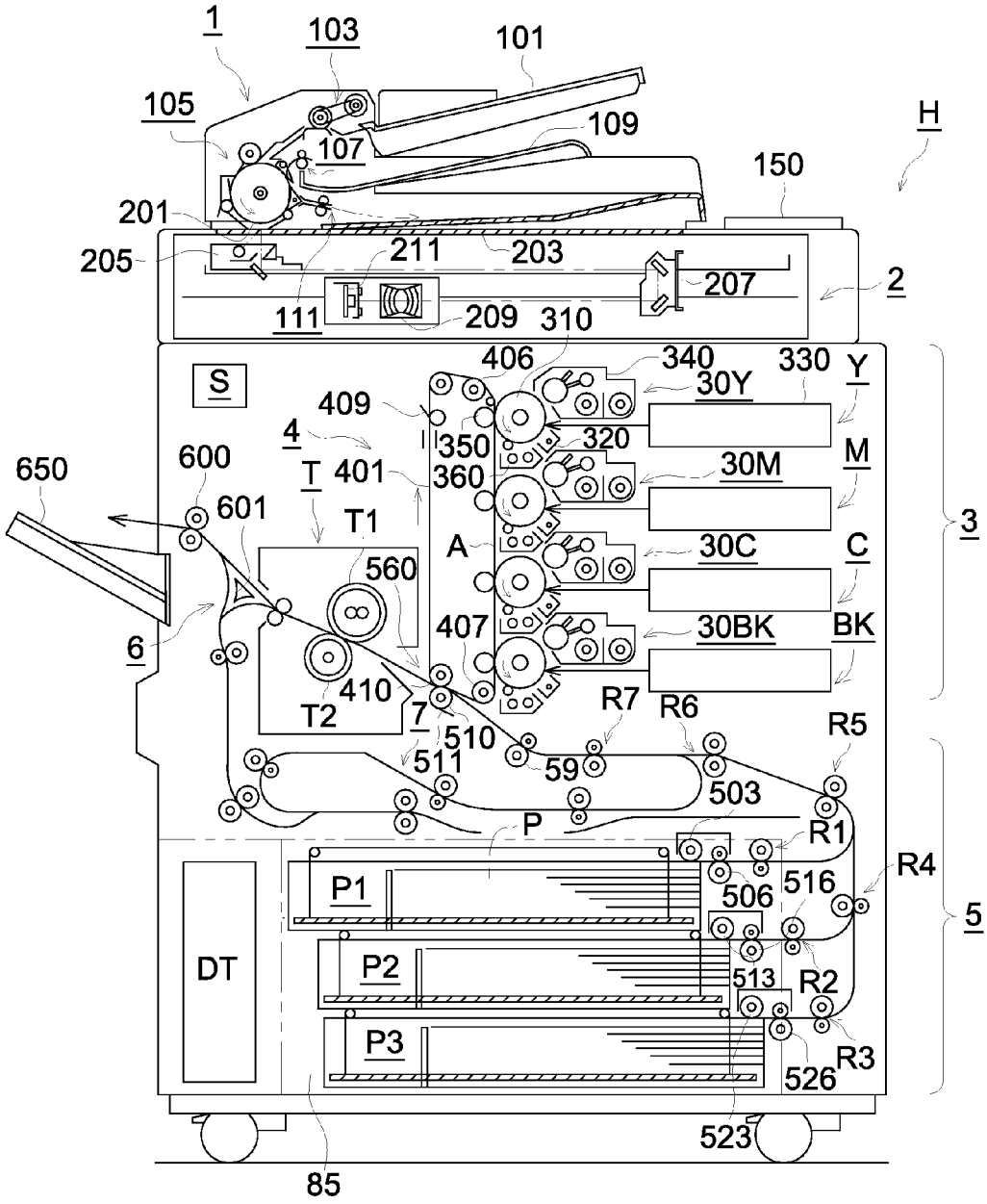
FIG. 1 is a schematic diagram showing the structure of an image forming apparatus that is composed of a digital color copying machine.

FIG. 1 is a schematic diagram showing the structure of an image fanning apparatus composed of a digital color copying machine.

Image forming apparatus H shown in the diagram has, on its upper portion, automatic document feeder 1, and has, in its inside, image reading section 2, image forming section 3, belt unit 4 for a belt installation section, transfer material feed section 5, fixing device T, reversal transfer material-ejection and re-transfer material-feeding section 6 and ADU 7 that is a reversal conveyance device.

The automatic document feeder 1 has therein document platen 101, document separation device 103, document conveyance section 105, document-ejection device 107, document ejection platen 109 and document reversal means 111.

Documents (not shown) on the document platen 101 are separated one transfer material by one transfer material by document separation device 103, to be conveyed toward the image reading position through document conveyance section 105.

A document reading position is provided on the lower portion of the document conveyance section 105, then, an image of the document is read through slit 201 that constitutes image reading section 2, and the document which has been read is ejected onto the document ejection platen 109 by the document-ejection device 107.

Incidentally, in the two-side copying mode, a document coming to this side after being read in terms of one side is interposed by the document reversal means 111, and after that, the document is reversed and conveyed by the rotation in the opposite direction of the document reversal means 111, to be guided again to the image reading position, to be ejected onto the document ejection platen 109 finally.

Image reading section 2 has therein slit 201, first mirror unit 205, second mirror unit 207, image forming lens 209, and line-shaped imaging element (hereinafter referred to as CCD) 211 which converts a photographic image formed by image forming lens 209 photo-electrically to obtain image information.

The image information undergoes appropriate image processing, and then, is stored temporality in a memory in controller S which will be explained later. Image information for each color which has been read by image reading section 2 is taken out successively from the memory, to be inputted to an exposure optical system for each color as an electric signal.

Image forming section 3 has image forming devices 30 (30Y, 30M, 30C and 30BK: which are called image forming units from now on) of four sets of yellow (Y), magenta (M), cyan (C) and black BK) which form toner images corresponding to color separation images. Image forming unit 30 for each color is composed of photoconductor drum 310 serving as image carrier, charging unit 320, exposure optical system 330 representing an image writing device, developing device 340, transfer device 350 and cleaning device 360. In the drawings, reference symbols are given only to the members constituting yellow image forming units, and reference symbols are omitted for other image forming units.

The developing device 340 has a developer carrier (a developing sleeve), and it stores a developer that includes magnetic carrier (hereinafter called a carrier simply) and non-magnetic toner that (that is called toner simply) is different for each developing device that is called toner simply.

The cleaning device 360 removes toner remaining on photoconductor drum 310 after the transfer, and the toner removed is conveyed to toner box DT to be stored.

The aforesaid image forming units 30 are arranged in the order of yellow (Y), magenta (M), cyan (C) and black (BK), along the advance direction of plane A of intermediate transfer belts 401 arranged to be long in the longitudinal direction.

Intermediate transfer belt 401 that serves as an intermediate transfer member, and supporting rollers 405, 406 and 407 about which the intermediate transfer belt 401 is trained, and backup roller 410 constitute the belt unit 4. The symbol 409 represents a blade (blade on the intermediate transfer side: primary transfer side blade), and it is provided in the counter direction for the direction of rotation of the intermediate transfer belt 410, to be pressed against a surface of the intermediate transfer belt under an appropriate pressure.

The numeral 510 represents a secondary transfer roller serving as the second transfer device, and it is against at backup roller 410 at a prescribed pressure through the intermediate transfer belt 401. The numeral 511 represents a blade (secondary transfer side blade) and it is provided in the counter direction for the rotation direction of secondary transfer roller 510, to be pressed against a surface of the secondary transfer roller under an appropriate contact pressure. Incidentally, as will be explained later, a bias power supply BD that outputs voltage of prescribed polarity (opposite polarity for toner charging polarity) is connected to secondary transfer roller 510. Further, the bias power supply BD is structured to be controlled in terms of turning on of electricity through the controller S. The controlling of turning on of electricity implies ON-OFF control of the bias power supply BD, variable control of ON-OFF time, or variable control of output voltage.

The aforesaid controlling of turning on of electricity is carried out for the purpose of keeping the patch image of toner prepared between image forming areas (between transfer materials) on an image carrier in a continuous image forming mode, for example, and supplied to the second transfer roller through the intermediate transfer belt usually and for the purpose of removing with blade 409. Or, the aforesaid controlling of turning on of electricity is carried out for the purpose of supplying a toner patch image conveyed to the secondary transfer area through intermediate transfer belt 401 to both of the secondary transfer roller 510 and the intermediate transfer belt 401 and for cleaning with a blade provided corresponding respectively. By supplying a toner patch image or toner that forms the toner image to the intermediate transfer belt 401 and to the secondary transfer roller, and by removing with a corresponding blade, it is possible to control turning up phenomena for each blade. In other words, it is possible to say that functions or multiplicity of uses by using a patch image have been enhanced.

Incidentally, for example, it is possible to stabilise image density by detecting density of patch image supplied to the secondary transfer roller as stated above with an optical sensor, by watching detection output with a controller S and by controlling bias voltage for developing sleeve of developing device 340, in case of need. The patch image in this structure can be used as a factor for image stabilization, and it can contribute to prevent phenomenon of turning on for the blade provided to be corresponding to the secondary transfer roller and to the intermediate transfer belt, which can broaden further a multiplicity of uses.

By putting the explanation back, each of P1 through P3 shows a transfer material tray that is arrange in the lower portion of the apparatus main body to store transfer materials (hereinafter referred to as transfer materials). On the feeding out portion, there are provided transfer material feed rollers 503, 513 and 523, separation rollers 506, 516 and 526, and conveyance rollers R1, R2 and R3. Transfer material P that is fed out by the aforesaid rollers is conveyed along a transfer material conveyance path on which conveyance rollers R5 through R7 are arranged. The numeral 59 represents a registration roller which is provided to be close to secondary transfer area (secondary transfer section) 560. On the position that is downstream side of the secondary transfer area (a position where the secondary transfer roller 510 is existing), there is provided fixing apparatus T whose main factors are first fixing roller T1 with a built-in heating source and second fixing roller T2 that rotates while pressure-contacting the first fixing roller T1. The numeral 600 represents a transfer material-ejection roller, and 650 represents transfer material-ejection tray.

A transfer material conveyance form relating to reversal transfer material-ejection and transfer material re-feeding section 6 and to ADU 7, and conveyance control are well-known, and both of them are not related directly to the present invention. Therefore, explanations for them are omitted.

Incidentally, reference symbol S is a controller (control section) including a computer, and it has a built-in program for mechanical operation, to conduct all controls including controls relating to series of image forming process, developing bias control, transfer material feed controls, and controls from preparation of the aforesaid patch image to selection control through bias power supply. In other words, the controller S has CPU that conducts an operation control processing, ROM that stores various types of operation programs, and RAM that stores data of results of operations. And it takes in output of various sensors into CPU through interface, and it drives and controls display devices.

In the aforesaid structure, when ordinary image forming process is started, a surface of photoconductor drum 310 that rotates counterclockwise is charged by charging device 320 to be in a prescribed polarity. Then, a light exposure corresponding to the first color signal by exposure optical system 330, namely, a light exposure corresponding to image signal for yellow (Y) is conducted, and a latent image corresponding to the yellow (Y) image is formed on photoconductor drum 310.

Reversal development is conducted on the latent image by a developing sleeve of a developing device 340 on which developing bias voltage is impressed, and the latent image is converted into a yellow (Y) toner image, and after that, the toner image is transferred onto intermediate transfer belt 401 by the action of transfer device 350.

Image information for signals of other colors to be started in order at a prescribed period of time from the starting of the image forming by the first color signal are conducted by each of image forming units 30 for magenta (M), cyan (C) and black (BK), by the process that is the same as the foregoing.

Each toner image on the photoconductor drum formed by each image forming unit is transferred successively to be superimposed with an image area where the yellow (Y) toner image exists, thus, color toner images superimposed on the intermediate transfer belt 401 are formed. On the other hand, transfer material P which is fed by transfer material feed roller 503 (513 and 523), corresponding to image forming process, is stopped with its transfer material tip touching the registration roller 59. Then, the transfer material P is fed again at timing to be superimposed with the color toner area on the intermediate transfer belt 401 by restarting of rotation of registration roller 59.

Next, in the secondary transfer area, transfer material P is pressed and interposed together with intermediate transfer belt 401 by backup roller 410 and by secondary transfer roller 510, and during this period, a color toner image on the intermediate transfer belt 401 is transferred onto transfer material P. In this case, a prescribed polarity from bias power supply (not shown) and voltage in an appropriate level for transfer are impressed on the secondary transfer roller 510. Transfer material P that has undergone transfer processing by secondary transfer roller 510 is separated from intermediate transfer belt 401, and then, is heated and pressurized by fixing device T, thus, toner is fixed on the transfer material P. The transfer material P which has been terminated in terms of fixing processing is ejected on transfer material-ejection tray 650 by transfer material-ejection roller 600.

Incidentally, surfaces of the intermediate transfer belt 401 which has passed through the secondary transfer area 560 and of the secondary transfer roller 510 are cleaned by an exclusive blade. The aforesaid operations are repeated for a quantity equivalent to the number of documents or to the necessary number of copies, so that a series of jobs are terminated.

Figure 2:
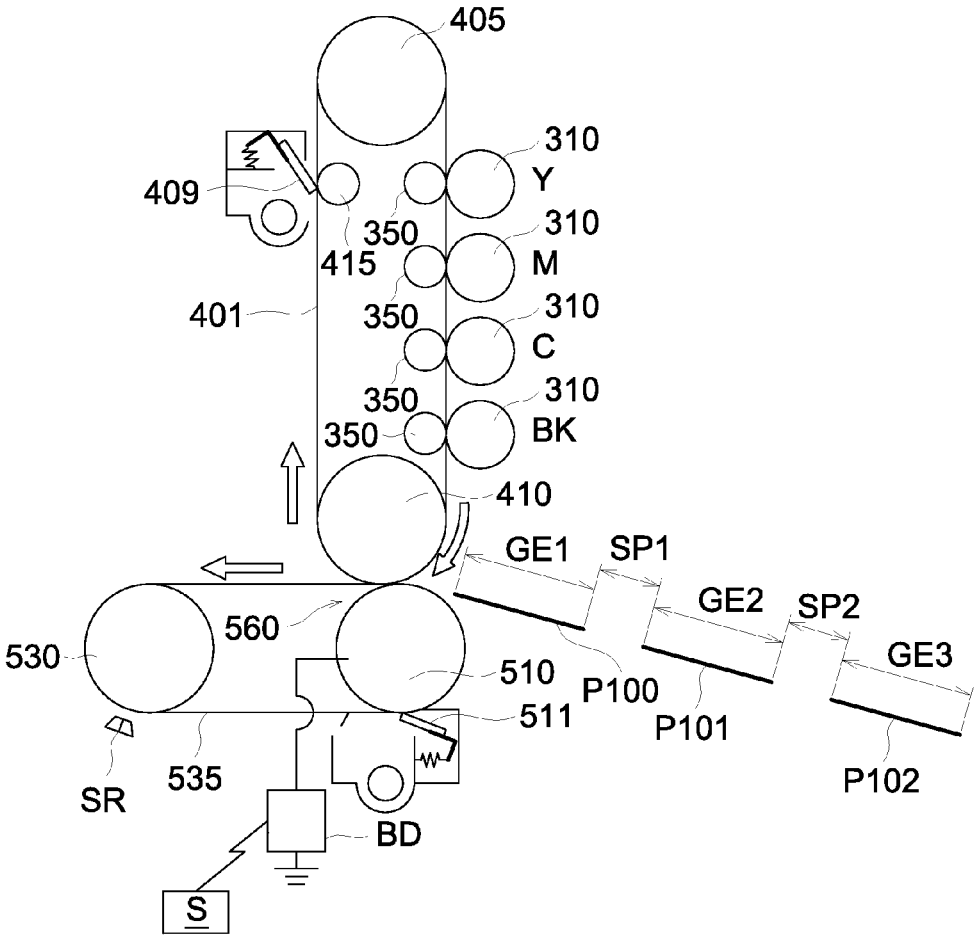
FIG. 2 is a schematic diagram showing the main structure device near the secondary transfer area by enlarging it.

Incidentally, manufacturing of a patch image for corresponding to turning on of a blade which has not explained above, and selective supply of toner forming the patch image for the intermediate transfer member and for the secondary transfer section, will be explained as follows, based on FIG. 2. In particular, FIG. 2 is a schematic diagram that shows a primary structure device in the vicinity of the secondary transfer area in FIG. 1, by enlarging the primary structure device. In the drawing, supporting of the intermediate transfer belt is shown to be simplified as is indicated by the supporting roller 405 and by backup roller 410. Further, as a secondary transfer device, a structure of a single secondary transfer roller 510 is replaced with a structure of a combination with secondary transfer belt 535 trained about secondary transfer roller and roller 530. The reason of employing the aforesaid structure is because of considering that the second transfer device structured by the second transfer belt and the second transfer roller can achieve the function that is the same as that of the structure of the single secondary transfer roller, and of considering that the drawings are easily observed. Incidentally, the following explanation is for the example wherein the image forming apparatus is in a mode to carry out image fanning continuously.

It is assumed that, members (devices) which achieve the functions similar to those of the members (devices) which have appeared are given the same reference symbols, and the explanation for them are omitted as far as possible. In FIG. 2, rotatable roller 415 is provided at a position on the inside of the intermediate transfer belt facing blade 409 for intermediate transfer belt 401. BD represents a bias power supply, and it is connected electrically so that bias voltage with a prescribed polarity may be impressed on secondary transfer roller 510. Incidentally, as stated above, the bias power supply BD is controlled in terms of turning on of electricity through controller S (ON-OFF switching control, variable control of ON-OFF time, or variable control of output voltage). In other words, the controller conducts turning on of electricity for bias power supply in synchronization with position movement of patch image. P100, P101 and P102 represent transfer materials, and they indicate the state wherein they are fed into secondary transfer area 560 in accordance with an image forming process.

Each of SP1 and SP2 shows a transfer material space (transfer material distance) generated between a trailing edge of a preceding transfer material and a leading edge of a succeeding transfer material, while, each of GE1, GE2 and GE3 shows a transfer material length in the conveyance direction. In other words, transfer material length GE is formed on image carrier 310, and it corresponds to an ordinary image area (that is the same as the image forming area) that is formed on intermediate transfer belt 401. Transfer material space (transfer material distance between adjoining two transfer materials) SP corresponds to a non-image area between adjoining two image areas on an image carrier or an intermediate transfer belt. With regard to the aforesaid transfer material distance between adjoining two transfer materials, it is possible to use it as a word showing an area on an image carrier or an intermediate transfer belt.

In the present embodiment (continuous image forming mode), a belt-shaped patch image having a length covering the whole length of blades 409 and 511 is formed in the area in the axial direction on the image carrier 310 corresponding to the aforesaid transfer material distance. The patch image may either be one made by the image forming unit alone that forms a black image (see FIG. 1), or be one made by four sets of image forming units. Further, an amount of toner for forming a patch image has only to be an amount that is sufficient to prevent turning on of blade 511, and it is possible by setting the conditions of a factor relating to the experiments.

In a simple explanation of the operations, an ordinary image (which is simply called an image hereinafter) that is formed on image carrier 310 based on image data and a patch image that is formed on a non-image area adjoining the image area are transferred onto intermediate transfer belt 401 to arrive at a secondary transfer area. In the secondary transfer area 560, the image is transferred onto transfer material P100, and the transfer material P100 is conveyed toward a succeeding process by secondary transfer belt 535. On the other hand, the patch image corresponding to the transfer material distance SP1 is transferred onto the secondary transfer belt 535. Transferring of an image and transferring of a patch image are conducted when bias power supply BD is controlled to be in the state of ON and when a bias voltage is impressed on secondary transfer roller 510. The patch image is moved in terms of its position by the secondary transfer belt 535, and is removed by blade 511. Processes for the succeeding image and for the succeeding patch image are conducted in the same way as in the foregoing.

In this case, one reason for causing a patch image prepared between the transfer material distance from time to time to be transferred onto the secondary transfer belt 535 is necessity of controlling prevention of turning up of blade 511, because toner to be supplied to the blade 511 is not generated basically in this structure. On the other hand, for the blade 409, there is an advantageous point that toner remaining on intermediate transfer belt 401 after transferring operations can be utilized. In this case, however, there is considered a fear that an amount of toner to be supplied to the blade 409 runs short in some cases. The present embodiment of the invention has the structure wherein, when the controller S judges that an amount of toner to be supplied for blade 409, for example, runs short, the bias power supply BD is switched to be OFF to be controlled, and a patch image is kept on the intermediate transfer belt 401 to be supplied to the blade 409. This implies that a patch image for the purpose of directing to blade 511 is to be used also in the case of troubles of blade 409, and it implies that a range of uses for the patch image can be broadened.

Energizing control for the bias power supply BD also can supply by dividing toner of patch image to both blades 409 and 511, by causing impression voltage for the secondary transfer roller 510 to be variable. Further, when a width of the patch image (a size of the intermediate transfer belt in the conveyance direction) has a prescribed width that can be controlled, it is possible to supply toner to both blades, by causing bias power supply BD to be ON for the front half and to be OFF for the rear half, for example, or by causing the order of them to be opposite.

Further, in the present embodiment, there is provided a structure wherein a patch image is formed for each transfer material distance, and this structure makes it possible to determine properly an amount of toner for forming a patch image or efficiency of a blade, depending on specifications. For example, it is also possible to form between plural transfer material distances, or to further divide to blade 409 and blade 511.

Further, as stated above relating to FIG. 1, it is possible to provide optical sensor SR so that it faces a part of secondary transfer belt 535, for example, to detect toner density of a patch image, to watch detection output with controller S and to control bias voltage for the developing sleeve of developing device 340, and thereby to achieve image density stabilization. This embodiment makes it possible to use a patch image as a factor to stabilize images, and it makes the patch image to be used for preventing turning up of the blade, which can broaden more the technical versatility.

The foregoing has been explained about a supply of toner in the mode of continuous image forming (same meaning as in the patch image). However, in the case of intermittent image forming, it is possible to satisfy by making a patch image on a non-image area adjoining the image forming area, for example. The non-image is in that case has the same meaning as that of the transfer material distance. Even in the case of the intermittent image forming, it is possible to control a phenomenon of turning up of the blade properly if the rate of operation is high to a certain level. However, when the rate of operation of the image forming apparatus is low, and when the structure is under the condition wherein the control keeps the intermediate transfer member and the secondary transfer section to be in the state of driving for a prescribed period of time after image forming is completed for one transfer material, on the other side, there is a fear that functions of blades 409 and 511 are damaged. In this case, it is possible to cope with this problem by watching with the controller S the elapsed time after image forming, and by dividing patch images to both blades in the method mentioned above, by providing a mode to make patch images with appropriate amount of toner after a prescribed period of time, in advance.

Figure 3:
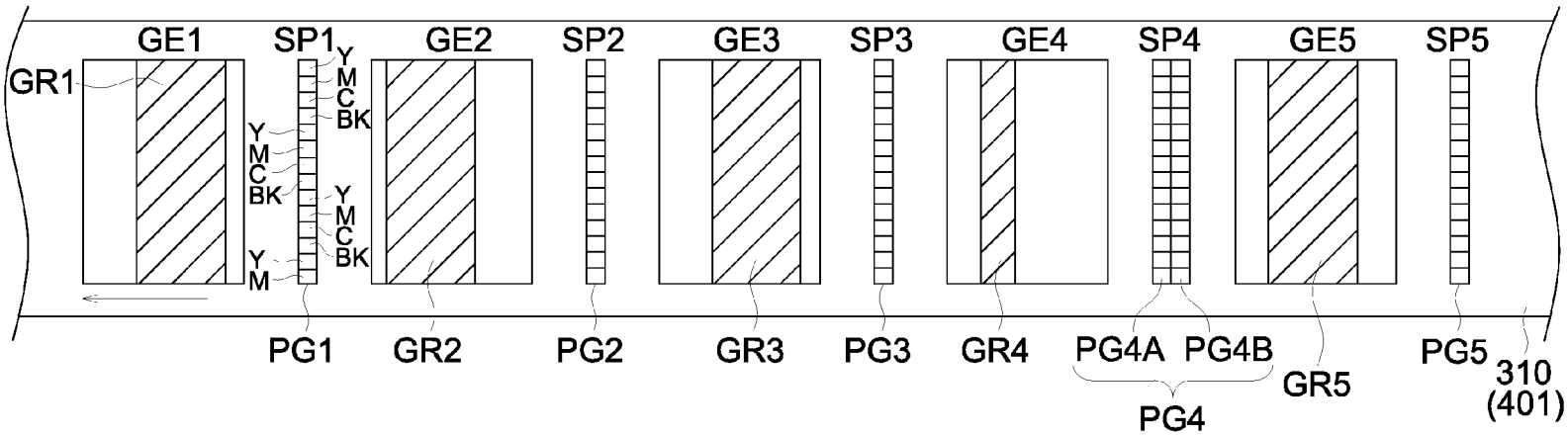
FIG. 3 is a diagram showing an outline of patch images in the case of forming full color images continuously.
Figure 4:
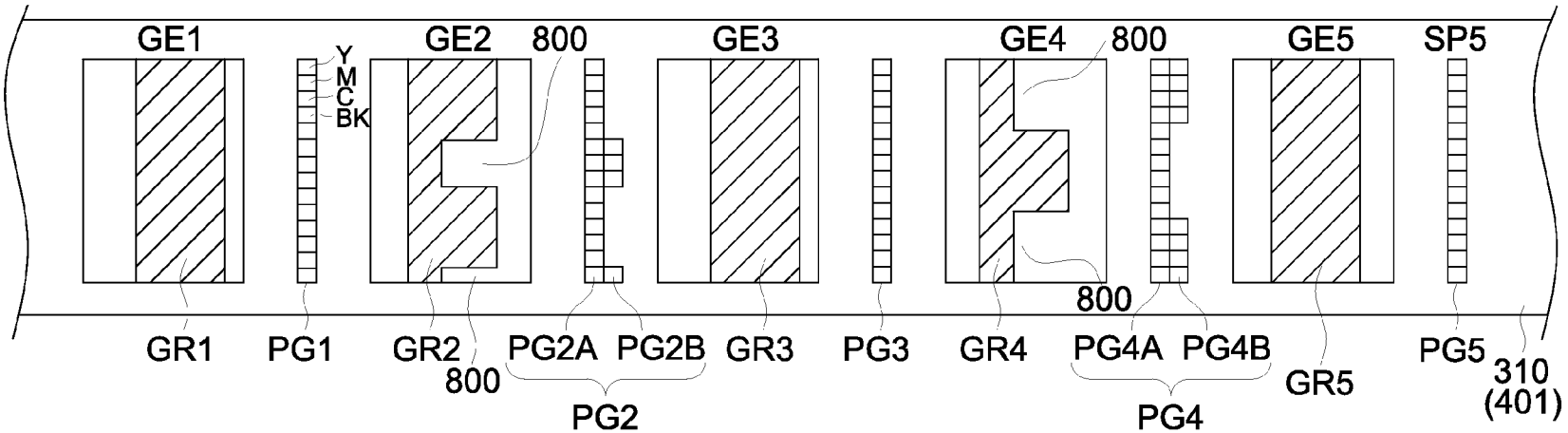
FIG. 4 is a schematic diagram showing that a patch image is changed in the axial direction of the image carrier by an image form when full color images are formed continuously.
Figure 5:
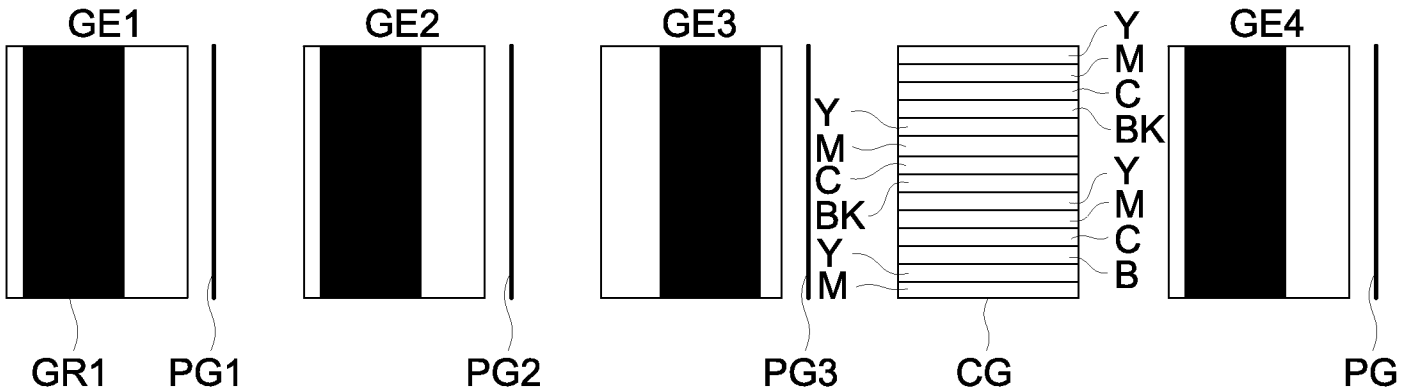
FIG. 5 is a diagram showing an outline of patch images in the case of forming monochromatic images continuously.
Figure 6:
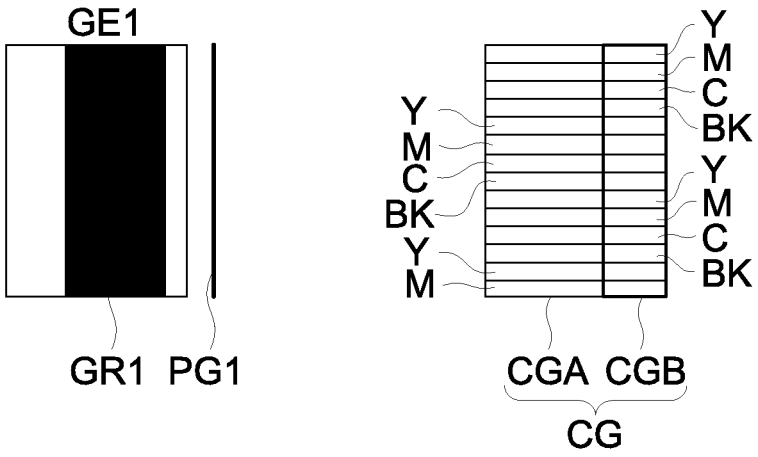
FIG. 6 is a diagram showing an outline of patch images in the case of forming monochromatic images intermittently.
Figure 7:
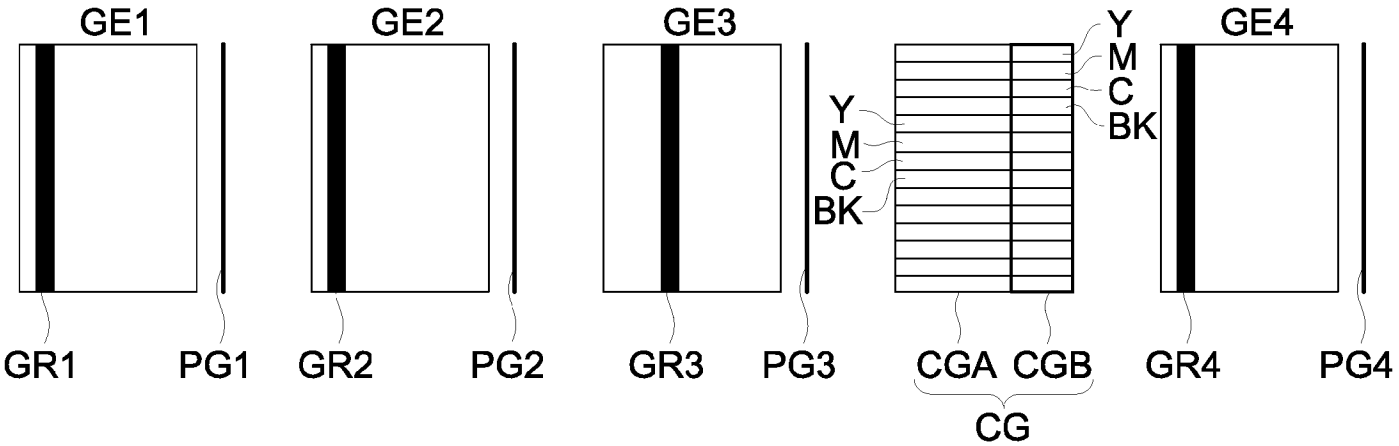
FIG. 7 is a diagram showing an outline of patch images in the occasion where monochromatic images are continued continuously, and a possession range of images for the image forming area is low.

Next, an embodiment relating to making of specific patch image by the use of FIGS. 3-7 will be explained as follows, with the structure and explanation relating to FIGS. 1 and 2. FIG. 3 is a diagram showing an outline of a patch image in the case of forming full color images continuously. FIG. 4 is a schematic diagram showing that a patch image was moved in the axial direction of the image carrier by the image form when a full color image was formed continuously. FIG. 5 is a diagram showing an outline of a patch image when monochrome images were formed continuously. FIG. 6 is a diagram showing an outline of a patch image when monochrome images were formed intermittently. FIG. 7 is a diagram showing an outline of a patch image when monochrome images were formed continuously and when a possession range of an image for the image forming area is low.

FIG. 3 shows a situation wherein images were formed continuously on the intermediate transfer belt 401 that serves as the aforesaid developed and shown image carrier 310 or as an intermediate transfer member, and patch images were formed on a non-image area between image forming areas. Incidentally, symbol GE (from GE1 to GE5) and SP (from SP1 to SP5) correspond to symbols (GE, SP) given to transfer materials, as explained in the explanation shown in FIG. 2. Therefore, GE is called an image forming area, and SP is called a non-image area or a transfer material distance.

Areas GR (from GR1 to GR5) which are covered by oblique lines in image forming area GE shown by a rectangle, show images, while, areas PG (from PG1 to PG5) show patch images.

Incidentally, patch image SP is a belt-shaped patch image that has a length covering the total length of blades 409 and 511 mentioned earlier in the axial direction (vertical direction in the drawing), and it is made with an amount of toner that is sufficient to control turning up of blade 511 of the secondary transfer section. Patch images PG are made by toner of four colors (Y, M, C and BK), and a division in the patch image PG shows a developing area that is formed by repetition of Y, M, C and BK toner in this order from the top.

In the present embodiment 1, there is shown that toner does not need to be supplied forcibly to blade 409 of intermediate transfer belt 401, because a possession range of image GR for image forming area GE is large in general. However, if the controller S judges that the possession range of image GR4 is small, and toner in a quantity needed for prevention of blade turning up for the intermediate transfer belt is not secured, patch image PG4B for the intermediate transfer belt is prepared. And, toner that forms the patch image is kept on the intermediate transfer belt through output switching control (OFF) of the bias power supply BD, and is supplied to blade 409. On the other hand, toner that forms patch images PG1, PG2, PG3, PG4A and PG5 is supplied to blade 511 of the secondary transfer section through energizing control (ON) of the aforesaid bias power supply BD. Incidentally, it is possible to structure so that the aforesaid judgment by the controller S may be made by acquiring image data In FIG. 4, requirements which are the same as those in FIG. 3 are given the same symbols. In the present second embodiment, what is different from the first embodiment is that the possession range of image GR has thereon irregularities. For example, the possession range of each of images GR 1, 3 and 5 in GE 1, 3 and 5 is large in general, and it has a rectangular shape roughly, but on images GR2 and GR4, there exist missing parts 800 for the rectangles. The missing parts 800 of this kind is considered to be caused by the occasion wherein an amount of toner remaining on the intermediate transfer belt 401 after secondary transfer is insufficient for controlling turning up of the blade 409 in the corresponding position. As stated above, if the controller S judges that the possession range of images GR2 and GR4 is small, and toner in a quantity needed for the blade of the intermediate transfer belt is not secured, patch images PG2B and PG4B for the intermediate transfer belt are prepared. And, toner that forms the patch images PG2B and PG4B is moved while it is kept on the intermediate transfer belt through switching control (OFF) of bias power supply BD, to be supplied to blade 409. On the other hand, toner that forms patch images PG1, PG2, PG3, PG4A and PG5 is transferred onto the secondary transfer belt that constitutes the secondary transfer section by energizing control (ON) of the aforesaid bias power supply BD, to be supplied to blade 511. Incidentally, it is possible to achieve the aforesaid judgment by the controller S by using prior art technology based on obtained image data, in the same way as in the first embodiment.

FIG. 5 shows a mode to form monochrome images continuously, and it shows an occasion where a possession range is low. Incidentally, symbols which are considered to be unnecessary are omitted, because how to show the diagram is the same as FIGS. 3 and 4 basically. In the present third embodiment, an amount of toner of monochrome patch images formed between transfer materials in a monochrome mode only is insufficient as an amount of supply. Therefore, it is necessary to supply toner for four colors collectively.

In the drawing, for example, a patch image (striped image) CG is prepared by four color toner at the rate of one transfer material per hundreds of transfer materials, then, bias power supply BD is turned on to transfer a color image onto the secondary transfer belt from the intermediate transfer belt, to supply to blade 511, thus, turning up of the blade is controlled.

With regard to prevention of turning up of a blade of the intermediate transfer belt, the prevention can be controlled by toner remaining after the secondary transfer of a high possession range image.

In the present embodiment stated above, a toner supply mode (color patch image making mode) used in a monochrome image making mode is carried out through the controller S. Though an area of patch image CG is larger than those of patch images PG in other embodiments, it is possible to avoid suspension of image forming operations and to maintain high productivity, by employing the toner supply mode of this kind.

FIG. 6 relates to the fourth embodiment to cope with a problem feared in intermittent image forming in monochrome image forming. Namely, when intermediate transfer belt 401 and secondary transfer belt 535 are in the occasion in the structure wherein the intermediate transfer belt 401 and the secondary transfer belt 535 are controlled to be kept to be in the state of drive for a prescribed period of time after image GR 1 is formed and patch image PG 1 is prepared, functions of the blades 409 and 511 are feared to be damaged. In this case, elapsed time, for example, after image forming is observed by the controller S, a toner supply mode is automatically established after the prescribed period of time established in advance, and patch image (striped image) CG is prepared with toner of four colors. Then, there will be shown an example wherein bias power supply BD is controlled so that toner on an area corresponding to CGA may be transferred onto the secondary transfer belt 535, and so that toner on an area (frame-enclosed area) corresponding to CGB may be held continuously on the intermediate transfer belt 401, to be supplied to respective blades.

FIG. 7 shows an occasion wherein, when monochrome images having less range are formed continuously, an amount of toner to be supplied to intermediate transfer belt 40 and to secondary transfer belt 535 tends to be insufficient. For the purpose of eliminating such troubles, a toner supply mode is automatically established by controller S, and patch image (striped image) CG by four colors is prepared. Then, the bias power supply BD is controlled so that toner on an area corresponding to CGA may be transferred onto secondary transfer belt 535, and toner on an area (frame-enclosed area) corresponding to CGB may be kept continuously on the intermediate transfer belt 401, to supply to respective blades. In the embodiments in FIG. 6 and FIG. 7, it is also possible to keep high productivity for image forming.

Incidentally, the energizing control by the controller can be conducted depending on history of a range in image area of transfer materials to be transferred by the secondary transfer device, and the history of the range in that case may either be the possession range value immediately before the new forming of images or be the average possession range value of several transfer materials, and it can be determined properly.

In the present invention, the structure is simple, because toner can be supplied selectively to the intermediate transfer member and to the secondary transfer section by the energizing control of the bias power supply BD connected electrically to the secondary transfer section.

What is claimed is:

1. An image forming apparatus comprising:

(a) a plurality of image carriers;

(b) an image forming section in accordance with each of the plurality of image carriers;

(c) an intermediate transfer member to which a toner image formed on at least one image forming section is primary transferred;

(d) a secondary transfer section which transfers the toner image that has been transferred on the intermediate transfer member onto a transfer material;

(e) a first cleaning blade provided on the intermediate transfer member, which cleans toner remained on the intermediate transfer member;

a second cleaning blade provided on the secondary transfer section, which cleans the toner remained on the secondary transfer section;

(g) a bias power source which is electrically connected to the secondary transfer section; and (h) a controller which is configured to be capable of causing the image forming section to form a patch toner image onto a non-image area on the image carrier corresponding to an area between adjoining two transfer materials and supplying the patch toner image to the secondary transfer section, and which controls the bias power source to conduct a power control in synchronization with a position moving timing of the patch toner image, to supply selectively the patch toner image on the non-image area between adjoining two transfer materials to the intermediate transfer member and the secondary transfer section.

2. The image forming apparatus of claim 1, wherein the secondary transfer section comprises a roller.

3. The image forming apparatus of claim 1, wherein the secondary transfer section comprises a belt and a roller about which the belt is trained.

4. The image forming apparatus of claim 1, wherein the power control by the controller represents a switching control of an output of the bias power source between turning on and off thereof.

5. The image forming apparatus of claim 1, wherein the power control by the controller represents a variable control of an output of the bias power source.

6. The image forming apparatus of claim 4, wherein the power control by the controller is carried out according to a history of a possession range of a toner to an image area of the transfer material to which the toner image has been transferred by the secondary transfer section.

7. The image forming apparatus of claim 5, wherein the power control by the controller is carried out according to a history of a possession range of a toner to an image area of the transfer material to which the toner image has been transferred by the secondary transfer section.

8. An image forming method comprising:

(a) forming a toner image on at least one of a plurality of image carriers;

(b) primary transferring the toner image onto a intermediate transfer member;

(c) transferring the toner image that has been transferred to the intermediate transfer member onto a transfer material;

(d) cleaning the toner image remained on the intermediate transfer member and the secondary transfer section with respective cleaning blades;

(e) forming a patch toner image on a non-image area of the image carrier corresponding to an area between adjoining two transfer materials, to supply the patch toner image to the secondary transfer section; and (f) controlling a turning on electricity of a bias power source that is electrically connected to the secondary transfer section, in synchronization with a position moving timing of the patch toner image, to supply selectively the patch toner image on the non-image area between adjoining two transfer materials to the intermediate transfer member and the secondary transfer section.

9. The image forming method of claim 8, wherein the step of the controlling comprises switching an output of the bias power source between turning on and turning off.

10. The image forming method of claim 8, wherein the step of the controlling comprises changing variably an output of the bias power source.

11. The image forming method of claim 9, wherein the step of the controlling is carried out according to a history of a possession range of a toner to an image area of the transfer material to which the toner image has been transferred by the secondary transfer section.

12. The image forming method of claim 10, wherein the step of the controlling is carried out according to a history of a possession range of a toner to an image area of the transfer material to which the toner image has been transferred by the secondary transfer section.

13. The image forming apparatus of claim 1, wherein the controller is configured such that when the controller judges that an amount of toner to be supplied to the first cleaning blade runs short, the controller switches the bias power supply off, and the patch image is kept on the intermediate transfer belt to be supplied to the first cleaning blade.

14. The image forming apparatus of claim 1, wherein the controller controls the bias power source to divide and supply toner of the patch image to both the first cleaning blade and the second cleaning blade by varying the impression voltage of the second transfer roller.

* * * * *